US005415391A

United States Patent [19]

Wong et al.

[11] Patent Number: 5,415,391

[45] Date of Patent: May 16, 1995

[54] LOW COST COMPACT INVERTER

[75] Inventors: Chee-Chiu J. Wong, Fairport; Lisbeth S. Quesnel, Pittsford, both of N.Y.

[73] Assignee: Xerox Corporation, Stamford, Conn.

[21] Appl. No.: 251,144

[22] Filed: May 31, 1994

[51] Int. Cl.[6] ..... B65H 5/00

[52] U.S. Cl. ..... 271/225; 271/186; 271/301; 271/303

[58] Field of Search ..... 271/184–186, 271/291, 301, 303, 225, 902, 265, 288; 355/318, 319, 320

[56] References Cited

U.S. PATENT DOCUMENTS 3,862,802 1/1975 Till ..... 355/23
4,359,217 11/1982 Roller et al. ..... 271/186
4,411,517 10/1983 Gerken ..... 271/225
4,412,740 11/1983 Buddendeck et al. ..... 271/225
4,477,068 10/1984 Arter et al. ..... 271/186

FOREIGN PATENT DOCUMENTS 0060762 4/1983 Japan ..... 355/318
0281241 11/1989 Japan ..... 271/186

*Primary Examiner*—H. Grant Skaggs

[57] ABSTRACT

A low cost, compact inverter for inverting sheets uses the existing paper path to invert a sheet. A sheet is inverted by being deflected into a channel formed between a turnaround roller and a baffle. The sheet is driven by the turnaround roller back into the original paper path in a direction opposite to the incoming direction of the sheet.

5 Claims, 2 Drawing Sheets

LOW COST COMPACT INVERTER

CROSS-REFERENCE TO RELATED APPLICATION

Copending and commonly assigned application Ser. No. 08/250,215, entitled Compact Inverter, by Jan Bares, and Thomas Acquaviva, filed on May 27, 1994, is hereby cross-referenced.

BACKGROUND OF THE INVENTION

This invention relates to an improved sheet inverting system, and more particularly, to a low cost inverter adapted to be placed within the normal paper path of low volume copier/printer products while providing enhanced product design possibilities due to its compact configuration.

In the field of reprographic machines, it is often necessary to feed along one of two alternate paths a copy sheet leaving the processor or the machine, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feeds it back into the processor, but inverted, so that the appropriate data can be applied to the second side of the sheet. One known sheet-feeder (U.S. Pat. No. 4,359,217) for effecting this includes three rollers in frictional or geared contact with each other, to provide two spaced-apart nips, one being an input nip to an associated downstream sheet pocket, and the other being an output nip for extracting each sheet from the pocket. A sheet reversing apparatus for reorienting a sheet so that a first side and an opposing side of the sheet may be operated upon is provided in U.S. Pat. No. 3,862,802 which includes a web for storing the sheets. These inverters have shortcomings when adaptation is attempted for insertion into low volume machines since they are costly, cumbersome and require more machine volume to implement than is desired.

The present invention aims at providing an inverter designed to have both simplex and duplex sheet fed to it along a common input path, and which sorts out the sheets as they are fed along the common path and either returns them in a direction opposite to the sheet feeding direction or passes the sheets further along the original sheet feed direction.

SUMMARY OF THE INVENTION

Accordingly, the present invention provides a low cost, compact inverter that uses the existing paper path to invert a sheet. A sheet is inverted by being turned over a roller that is positioned within a baffle and then passed back into the original paper path now in a direction reverse to the incoming sheet direction. If inversion is not required, the sheet is allowed to bypass the turnaround roller and proceed in the original direction.

BRIEF DESCRIPTION OF THE DRAWINGS

The foregoing and other features of the instant invention will be apparent from a further reading of the specification, claims, and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the low cost, compact inverter system for a copier/printer. However, it should be understood that the sheet inverting method and apparatus of the present invention could be used with any machine in which reversal or inversion of a sheet is desired.

In general, an improvement to prior sheet inverter systems of machines is disclosed which is cost effective and space efficient and comprises the use of a compact inverter that uses the existing paper path to invert a sheet.

Figure 1:
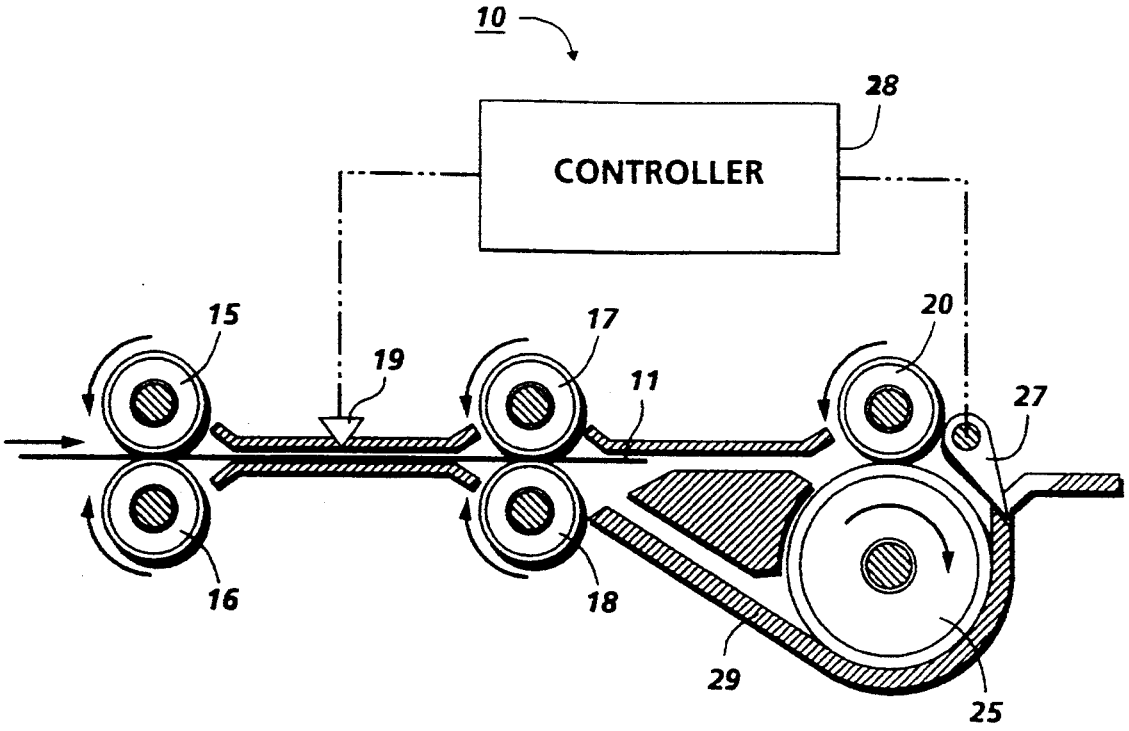
FIG. 1 is a schematic of the inverter in accordance with the present invention showing a sheet being fed along a common paper path to the inverter in a first direction.
Figure 2:
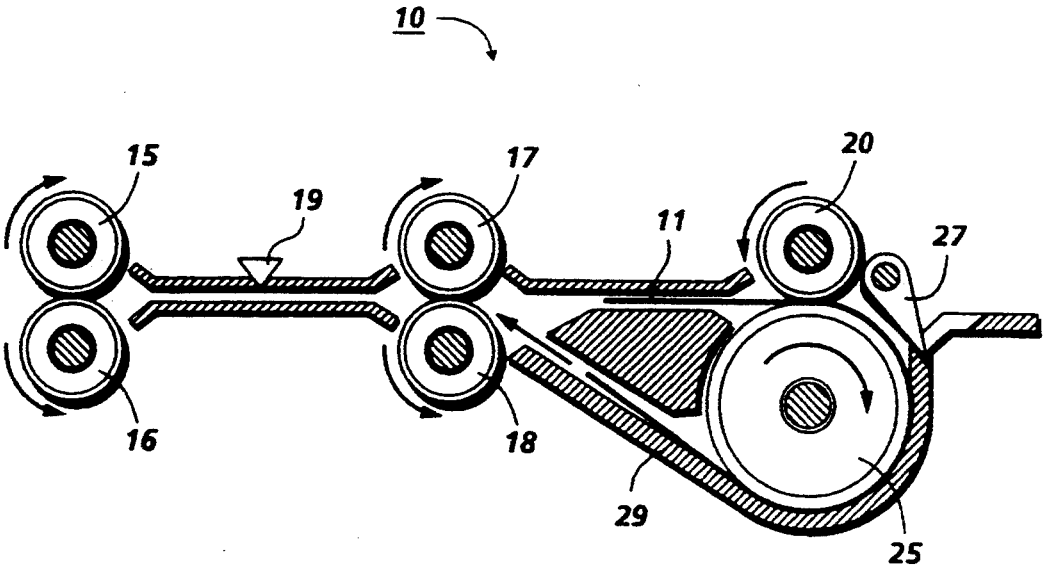
FIG. 2 is a schematic of the inverter of FIG. 1 showing the sheet in the process of being inverted.

Referring now particularly to FIG. 1, there is illustrated an exemplary inverter 10 for use in any conventional machine that requires sheets to be inverted. The inverter 10 comprises in-line reversible rollers (16, 18) that have complimentary idler rollers (15, 17) forming nips therewith, respectively, to convey substrates, such as, paper sheets 11 past sensor 19 en route to sheet turnaround roller 25. The reversible drive rollers are driven in a clockwise direction in FIG. 1. An idler roller 20 forms a nip with turnaround roller 25 in order to convey sheet 11. A baffle 29 is positioned adjacent a major portion of turnaround roller 25 to guide sheet around the roller and back into a nip formed between rollers (17, 18). Downstream from the nip formed between idler roller 20 and turnaround roller 25 is a deflector gate 27. The gate is adapted to be pivoted to either one of two limit positions such that when it is in a first or UP position, it is out of the path of a sheet and allows the sheet to pass it. When the gate is in a second or DOWN position as shown in FIGS. 1 and 2, it deflects a sheet into a space between baffle 29 and turnaround roller 25. Sensor 19 is connected to controller 28 which controls different machine actuations, such as, the positioning of gate in either one of its two positions.

In FIG. 2, the sheet 11 has been deflected into the channel formed between the turnaround roller 25 and baffle 29 and is being driven by the turnaround roller into reversible rollers (17, 18) that are now driven in a counterclockwise direction to convey the sheet 11 back into the existing sheet path in a direction opposite to its incoming direction for duplexing (copying onto the opposite side of the sheet) purposes.

Figure 3:
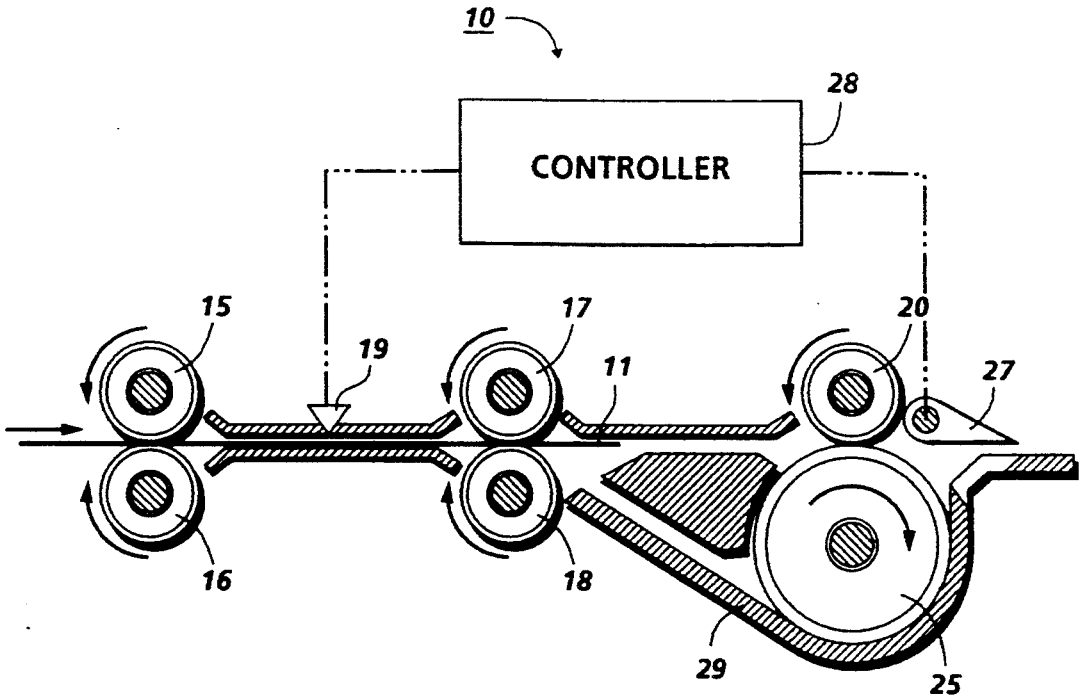
FIG. 3 is a schematic of the inverter of FIG. 1 showing the sheet after it has been inverted and being transported in a second and opposite direction to the first direction.
Figure 4:
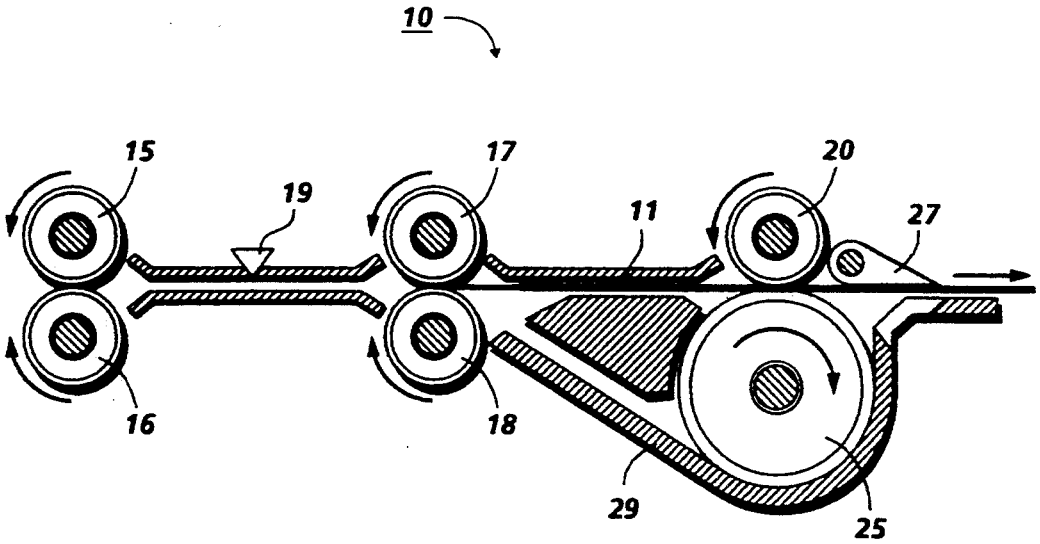
FIG. 4 is a schematic of the inverter of FIG. 1 showing a sheet being fed along the common paper path and bypassing the turnaround roller of the inverter.

FIGS. 3 and 4 depict the actions of inverter 10 when sheet inversion is not required. As shown in FIG. 3, sheet 11 is driven by reversible drive rollers (16, 18) toward the nip formed between turnaround roller 25 and idler roller 20. The sheet is sensed by lead edge sensor 19 which signals conventional controller 28 that in turn actuates gate 27 to its UP position and, as shown in FIG. 4, so that it does not intercept sheet 11 as it is driven by turnaround roller 25. This allows the sheet to pass straight through the inverter without being inverted.

In conclusion, a low cost, compact inverter has been disclosed that uses the existing paper path of a copier/-printer to invert a sheet. The inverter apparatus inverts a sheet by turning it over a roller situated within a baffle and driving the sheet back into the original paper path in a direction opposite from which it came into the inverter.

It is, therefore, evident that there has been provided in accordance with the present invention an inverter apparatus for copiers/printers or the like which fully satisfies the above-mentioned aims and advantages. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An inverter device, comprising:

two reversible drive rollers forming separate nips with idler rollers for driving a sheet in either of two directions;

a turnaround roller adapted to form a nip with an idler roller with said nip being positioned to receive a sheet being driven in a horizontal plane;

a baffle positioned around a portion of said turnaround roller, and wherein one of said reversible drive roller nips is positioned immediately adjacent said turnaround roller to receive a sheet exiting said baffle around turnaround roller at an acute angle with respect to a horizontal plane through the contact point between said reversible drive roller and said idler roller of said one of said reversible drive roller nips; and a gate positioned downstream of and in the same plane of said nip formed between said turnaround roller and idler roller, said gate being adapted to either intercept a sheet and direct it into a channel formed between said baffle and said turnaround roller for inversion purposes or to not intercept the sheet and allow the sheet to pass through the inverter device without being inverted.

2. The inverter device of claim 1, including controller means for actuating said gate into either a sheet intercept or non-intercept position depending on whether inversion is or is not required.

3. The inverter device of claim 2, including a sensor for sensing the lead edge of a sheet and signaling said controller.

4. A method of inverting or not inverting a sheet passing through an inverter, comprising the steps of:

providing at least two reversible drive rollers forming separate nips with idler rollers for driving a sheet in either of two directions;

providing a turnaround roller adapted to form a nip with an idler roller downstream of said at least two reversible drive roller nips and in the same plane as said at least two reversible drive roller nips;

feeding a sheet by said at least two reversible drive roller nips in one of said two directions into said nip formed between said turnaround roller and idler roller;

providing a baffle positioned around a portion of said turnaround roller;

providing a gate adapted to either intercept the sheet and direct it into a channel formed between said baffle and said turnaround roller for inversion purposes or to not intercept the sheet and allow the sheet to pass through the inverter device without being inverted;

providing a sensor for sensing the lead edge of a sheet when inversion is required and giving off a signal;

providing a controller for receiving the signal from said sensor and actuating said gate into a sheet intercept position; and positioning one of said reversible drive roller nips to receive a sheet exiting said baffle around turnaround roller at an acute angle with respect to a horizontal plane through the contact point between said reversible drive roller and idler roller of said one of said reversible drive roller nips.

5. The method of claim 4, including the step of receiving the sheet in said reversible drive roller nips as it leaves said turnaround roller and reversing said reversible drive roller nips to feed the sheet in the other of said two directions, and subsequently reversing said reversible drive roller nips to feed the sheet in said one of said two directions.

* * * * *